US007892110B2

(12) United States Patent
Bertolino, Jr.

(10) Patent No.: US 7,892,110 B2
(45) Date of Patent: Feb. 22, 2011

(54) GOLF CLUB TRAINING AND WARM-UP APPARATUS

(75) Inventor: Frank John Bertolino, Jr., Boston, MA (US)

(73) Assignee: Frank J. Bertolino, Jr., Boston, MA (US)

( * ) Notice: Subject to any disclaimer, the term of this patent is extended or adjusted under 35 U.S.C. 154(b) by 0 days.

(21) Appl. No.: 11/671,258

(22) Filed: Feb. 5, 2007

(65) Prior Publication Data

US 2008/0188319 A1 Aug. 7, 2008

(51) Int. Cl.
*A63B 69/36* (2006.01)

(52) U.S. Cl. ..... 473/342; 473/226; 473/335

(58) Field of Classification Search ..... 473/219, 473/226, 229, 236, 256, 334, 335, 337, 342
See application file for complete search history.

(56) References Cited

U.S. PATENT DOCUMENTS

| | | | | | |
|---|---|---|---|---|---|
| 2,884,698 | A * | 5/1959 | Wursch | 33/500 |
| 3,220,733 | A * | 11/1965 | Saleeby | 473/335 |
| 3,368,812 | A * | 2/1968 | Baldwin, Sr. | 473/330 |
| 3,398,961 | A * | 8/1968 | Higdon | 473/242 |
| 4,842,280 | A * | 6/1989 | Hilton | 473/231 |
| 5,141,231 | A * | 8/1992 | Cox | 473/330 |
| 5,718,644 | A * | 2/1998 | Donofrio | 473/340 |
| 6,095,930 | A * | 8/2000 | Siddall | 473/251 |
| 6,367,126 | B1 * | 4/2002 | Rivkin | 24/3.3 |
| 6,652,387 | B2 * | 11/2003 | Liberatore | 473/256 |
| 6,716,111 | B2 * | 4/2004 | Liberatore | 473/256 |
| 7,061,354 | B1 * | 6/2006 | Leupold | 335/285 |
| 2006/0276258 | A1 * | 12/2006 | McLaughlin | 473/236 |
| 2007/0015607 | A1 * | 1/2007 | Hot | 473/372 |

* cited by examiner

*Primary Examiner*—Nini Legesse
(74) *Attorney, Agent, or Firm*—Burns & Levinson LLP; Bruce D. Jobse, Esq.

(57) ABSTRACT

A training apparatus for temporarily increasing the weight of a golf club head has a body member having a perimeter profile which may at least partially mimic that of the golf club head and has a substantially flat surface for positioning adjacent the striking face of the golf club head. When fixed to the head of a golf club, the training apparatus increases the weight of the club and redistributes the center of gravity closer to the club head, allowing the golfer to benefit more from warm-up swings prior to actual play. The training apparatus may be formed of metal and contains a cutout or cavity in which a magnetic material resides to enable temporary attachment to the club head. In various other embodiments, the body member of the training apparatus may be substantially formed from either all metal or all magnetic material. In still other embodiments, a kit contains a golf club, the training apparatus, and a mechanism for removably attaching the training apparatus to or from the head of the golf club, such mechanism may be a magnet disposed in either the golf club head or the training apparatus. The size, profile and weight of the training apparatus may be modified to accommodate use with either right-handed, left-handed, women's and juniors golf clubs.

4 Claims, 11 Drawing Sheets

GOLF CLUB TRAINING AND WARM-UP APPARATUS

FIELD OF THE INVENTION

The present invention relates to the sport of golf, and, more particularly, to an apparatus for temporarily increasing the weight of a golf club head.

BACKGROUND OF THE INVENTION

Golf is an internationally popular sport and has been for some time. Various devices and techniques have been patented to assist golfers with correcting their swings. Recently, a line of clubs with adjustable heads have become commercially available. These clubs allow the distribution of weight within a club head to be adjusted to compensate for errors in the golfer's swing, e.g., a chronic hook to the right, etc. As such, these devices don't actually correct a golfer's swing, they merely compensate for the error by causing a different ball flight path.

Some golfers attempt to improve their swing by warming up prior to commencing play or after switching clubs. One known technique of warming up is to swing two clubs at once. Because of the awkwardness of holding two clubs and the overall distribution of weight at the club heads, this technique does not accurately represent the feel of a heavier golf club head. Other golfers swing specially weighted "warm-up" clubs that include a permanently weighted club head. The disadvantage of such clubs is that they are heavy to carry and can never be used in regular play because the additional weight used for or warm-up swings can never be removed from the club head.

Accordingly a need exists for an apparatus that will enable the weight of the head of commercially available golf clubs, particularly on irons, to be increased temporarily, so as to allow a golfer to practice with a heavier club prior to commencing play.

A further need exists for a small, relatively light weight apparatus that can be removeably attached to the head of commercially available golf clubs, to temporarily increase the weight of the club head so as to allow a golfer to practice with a heavier club prior to commencing play.

Yet a further need exists for an apparatus that can be removeably attached to the head of commercially available golf clubs without tools or changing the distribution of weight throughout the club head on a permanent or semi-permanent basis.

A further need exists for a training system that enables golfers to practice warm-up swings with a standard golf club having a temporarily overweighted club head, prior to commencement of play, and which allows removal of the additional weight from the club head at the time of play.

SUMMARY OF THE INVENTION

According to the present invention, a training apparatus for temporarily increasing the weight of a golf club head comprises a body member having a perimeter profile which may at least partially mimic that of the golf club head and has at least one substantially flat surface for positioning adjacent the striking face of the golf club head. When fixed to the head of a golf club, the training apparatus increases the weight of the club and redistributes the center of gravity closer to the club head, allowing the golfer to benefit more from warm-up swings prior to actual play. In one embodiment, the training apparatus may be formed of metal and contains a cutout or cavity portion in which a magnetic material resides to enable temporary attachment to the club head. In various other embodiments, the body member of the training apparatus may be substantially formed from either all metal or all magnetic material. In still other embodiments, a kit contains a golf club, the golf club training apparatus, and a mechanism for removably attaching the training apparatus to or from the head of the golf club. Such mechanism may comprise a magnet disposed in either the golf club head or the training apparatus. The size, profile and weight of the training apparatus may be modified to accommodate use with any of right-handed, left-handed, women's or junior's golf clubs.

According to one aspect of the invention, a training apparatus, for use with a golf club having a golf club head with a curved perimeter surface that partially defines a substantially planar striking face, comprises: (A) a body member comprising: (i) a substantially planar contacting face at least partially defined by an exterior perimeter surface of the body member; and (ii) a mechanism that coacts with the club head for maintaining contact between the contacting face of the body member and the striking face of the club head. In one embodiment, the mechanism that coacts with the club head is a magnet comprising a material selected from the group consisting of Neodymium Iron Boron, Samarium Cobalt, Ceramic and Alnico. In one embodiment, the mechanism that coacts with the club head comprises a magnetizable metal. In another embodiment, the body member may be comprised of substantially for either a magnetic material or a magnetizable metal.

According to second aspect of the invention, an article of manufacture for use with a golf club having a golf club head with a curved perimeter surface that partially defines a substantially planar striking face comprises: (A) a body member comprising: (i) a partially curved perimeter surface; (ii) a substantially planar contacting face at least partially defined by the curved perimeter surface of the body member; and (iii) an interior cavity disposed along the contacting face; and (iv) a magnet disposed within the interior cavity. In one embodiment, the article of manufacture further comprises a layer of magnetizable metal disposed adjacent the body member along at least part of the contacting face.

According to a third aspect of the invention, an article of manufacture, for use with a golf club having a golf club head with a partially curved perimeter surface that partially defines a substantially planar striking face for impacting a golf ball, comprises: (A) a magnet comprising a body member comprising: (i) a partially curved perimeter surface; and (ii) a substantially planar contacting face at least partially defined by the curved perimeter surface of the body member.

According to a fourth aspect of the invention, a kit comprises: (A) a golf club having a golf club head with a partially curved perimeter surface that partially defines a substantially planar striking face; (B) a club head training weight with a planar contacting face disposable adjacent the striking face of the golf club head; and (C) a mechanism for removably attaching the contacting face of the club head training weight to the striking face of the golf club head. In one embodiment, the mechanism for removably attaching the contacting face to the striking face comprises a magnetic material disposed within either of the golf club head or club head training weight.

According to a fifth aspect of the invention, a method comprises: (A) providing a golf club having a golf club head with a partially curved perimeter surface that partially defines a substantially planar striking face; (B) providing a club head training weight with a planar contacting face; and (C) temporarily attaching the contacting face of the club head training weight to the striking face of the club head. In one embodiment, the method further comprises the step of detaching the contacting face of the club head training weight from the striking face of the club head.

BRIEF DESCRIPTION OF THE DRAWINGS

The above and further advantages of the invention may be better understood by referring to the following description in conjunction with the accompanying drawings in which.

DETAILED DESCRIPTION

Figure 1A:
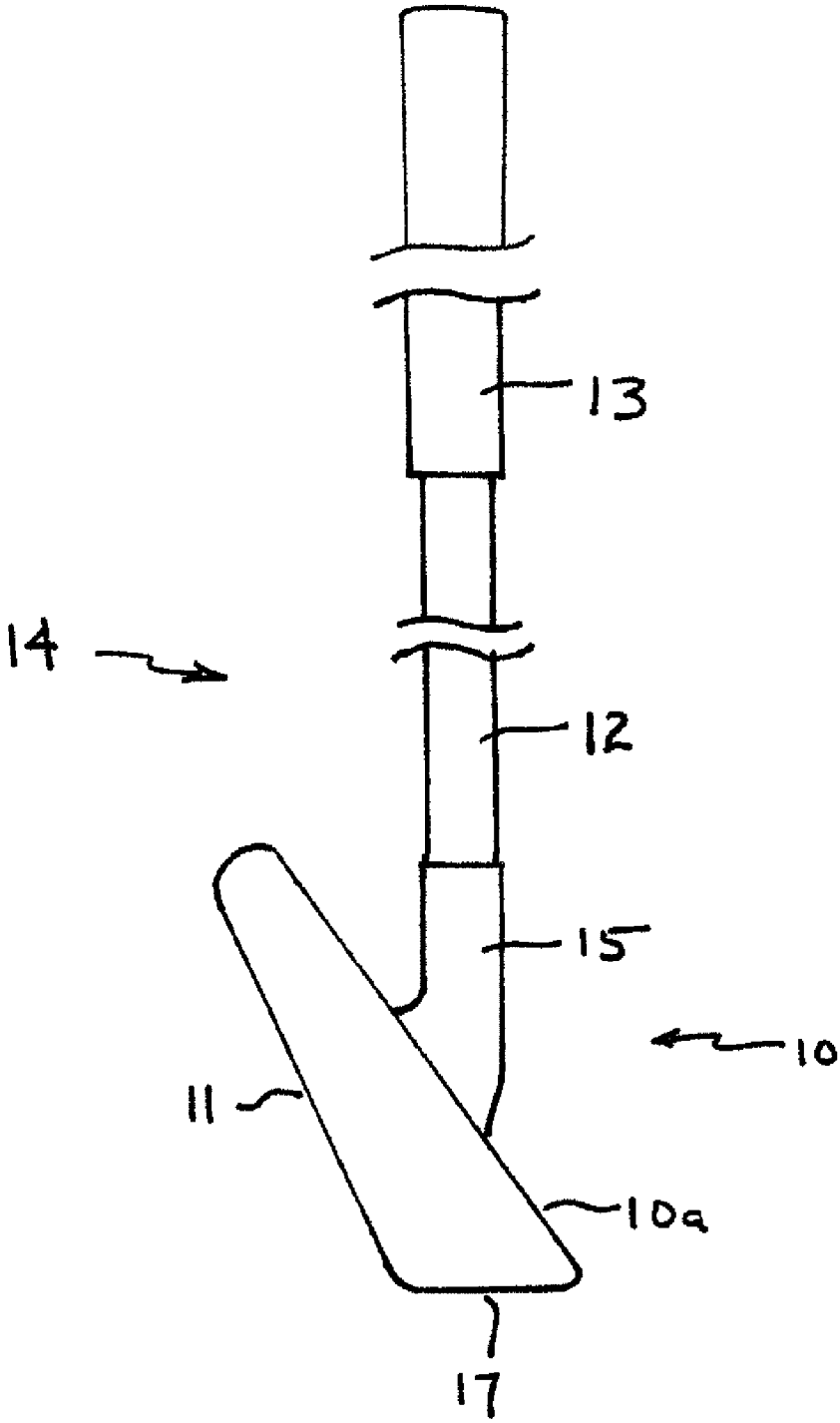
Figure 1A Prior Art
FIGS. 1A-B illustrate partial side and front views of a typical prior art golf club suitable for use with the training apparatus of the present invention.
Figure 1B:
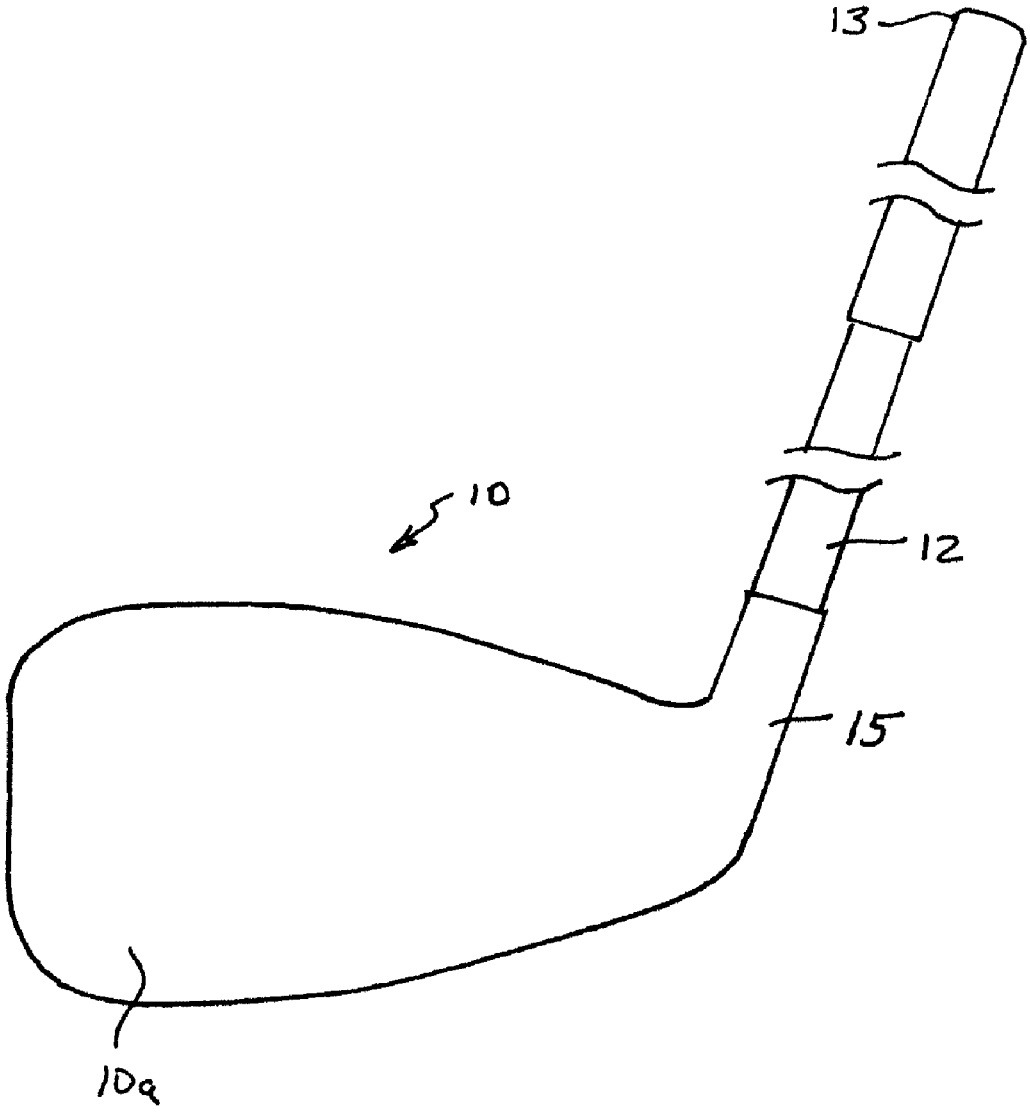
Figure 1B Prior Art

Referring now to the drawings, and particularly to FIGS. 1A-B, a prior art golf club 14 comprising a handle 13, shaft 12 and golf club head 10, with a design similar to any number of commercially available golf clubs, is illustrated in side and front views, respectively. Club head 10 is connected to shaft 12 by hosel 15. A face 10*a* of club head 10 forms an angle with the bottom plane or sole 17 of the club, in accordance with US or international golfing regulations, and serves as the striking surface for imparting the momentum of the club head to the golf ball. In order to partially accommodate the incline of face 10*a*, the thickness of club head 10 between back 11 and face 10*a* tapers from approximately ¼" at the top to approximately ½" at the sole 17, (club head 10 not shown to scale in FIG. 1A). Other golf club heads configurations exist in various shapes and sizes and may be used with equal success with the inventive apparatus described herein.

Figure 2:
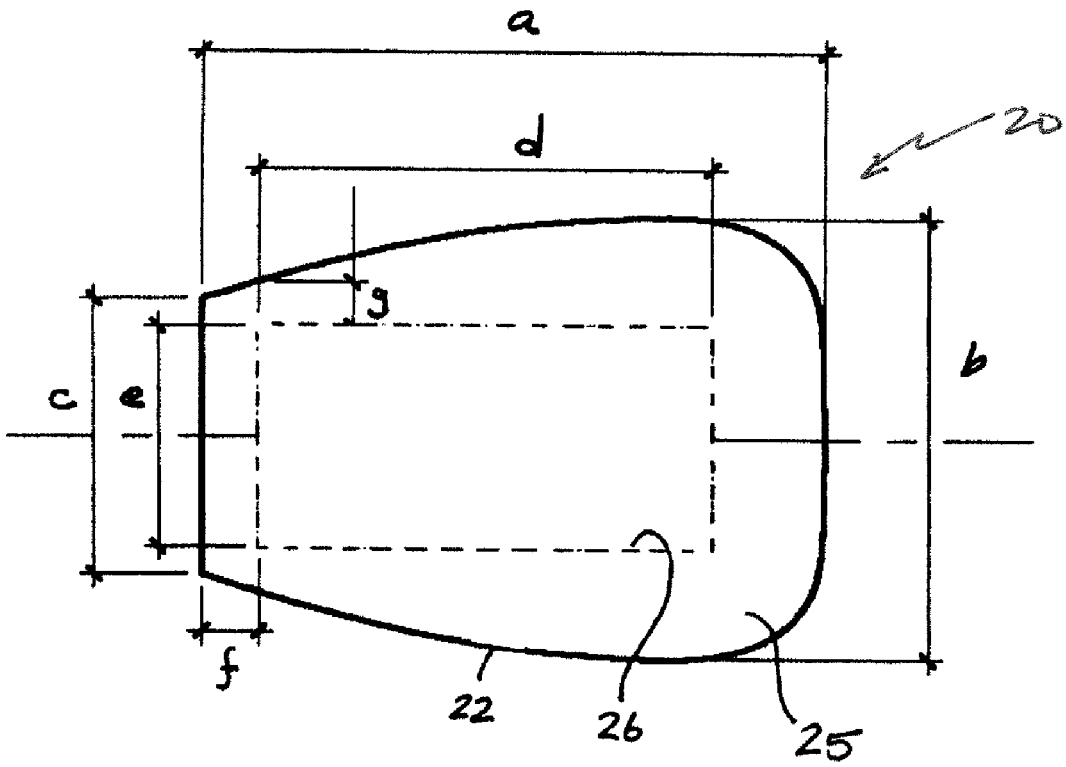
FIG. 2 is a front view of the training apparatus in accordance with the present invention.
Figure 3:
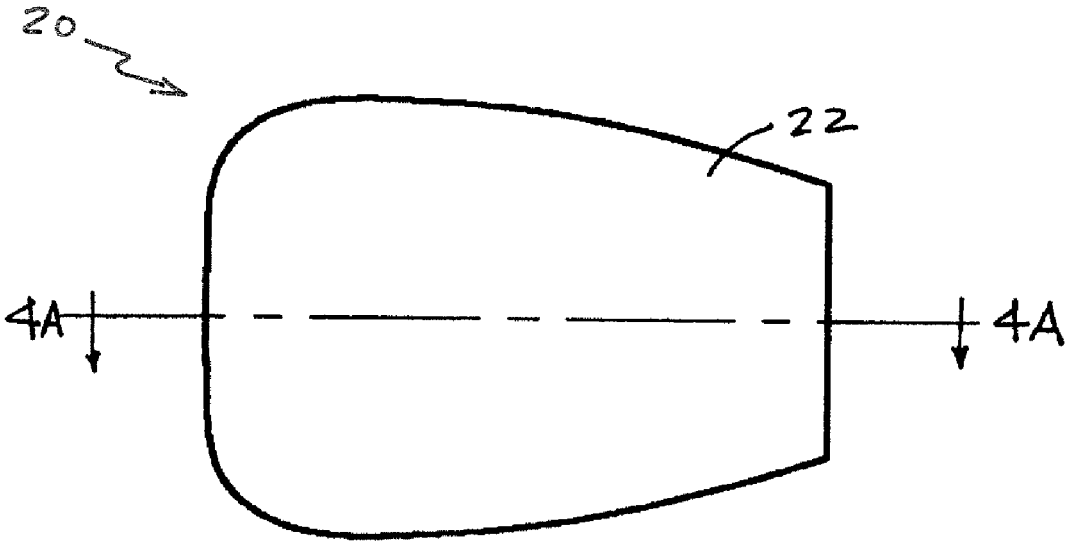
FIG. 3 is a rear view of the training apparatus in accordance with the present invention.

FIGS. 2-11 illustrate various views of a golf club training weight 20 in accordance with the present invention. In the illustrative embodiment, weight 20 comprises a casing 22 having a contact surface 25. A magnet 24 may be disposed in an interior portion of casing 22, beneath or as part of contact surface 25. FIGS. 2-3 illustrate front and rear views, respectively, of weight 20, with the approximate location of magnet 24 illustrated in phantom in FIG. 2. The exterior perimeter of weight 20, that is the edge extents of contact surface 25, may be shaped to approximate or mimic that of face 10*a* of club head 10. In the contemplated in embodiments, such approximation by the exterior perimeter of weight 20 may comprise any of the exact shape of face 10*a*, a parallel or proportional modification of the face 10*a*, or modifications in the shape and/or area of the face 10*a*. Referring to FIG. 2, weight 20 may have a length, illustrated as dimension a, of approximately 2¾" a maximum height b, illustrated as dimension b, of approximately 2"; and a minimum height c, illustrated as dimension c, of approximately 1¼". As illustrated, the height of weight 20 may taper between its respective minimum and maximum in a manner that mimics the perimeter of striking face 10*a* of club head 10 so that contact surface 25 of weight 20 substantially covers striking surface 10*a* of club 10. In one embodiment, an interior cavity or indentation 26 is formed in the body of casing 22 to accommodate a magnet or deposition of a material having a magnetic properties. In an exemplary embodiment, which is not meant to be limiting, cavity 26 and magnet 24 have a substantially rectangular shape with a length d, illustrated as dimension d, of approximately 2" and a height e, illustrated as dimension e, of approximately 1", as shown in FIG. 2, Cavity 26 and magnet 24 and may be disposed a distance f, illustrated as dimension f, of approximately ¼" from the end edge of contact surface 25 at the height minimum, as illustrated, and a distance g, illustrated as dimension g, of approximately 3/16" from the top or bottom edge of contact surface 25, as illustrated. Cavity 26 may have a depth within the body of casing 22 of approximately ½". The approximate location of cavity 26 within the body of casing 22 is illustrated in phantom in FIG. 2.

Figure 4A:
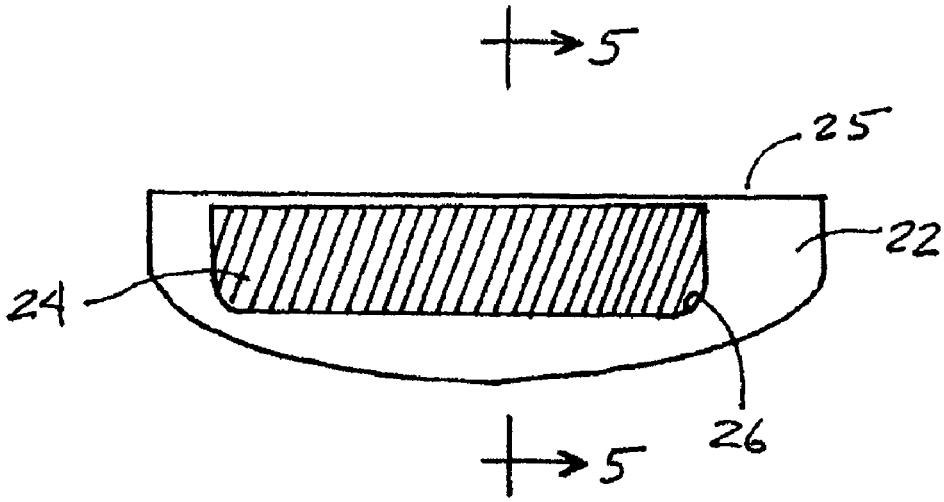
FIG. 4A is a top, cut-away view of the training apparatus as taken along line 4A-4A of FIG. 3 in accordance with the present invention.
Figure 5:
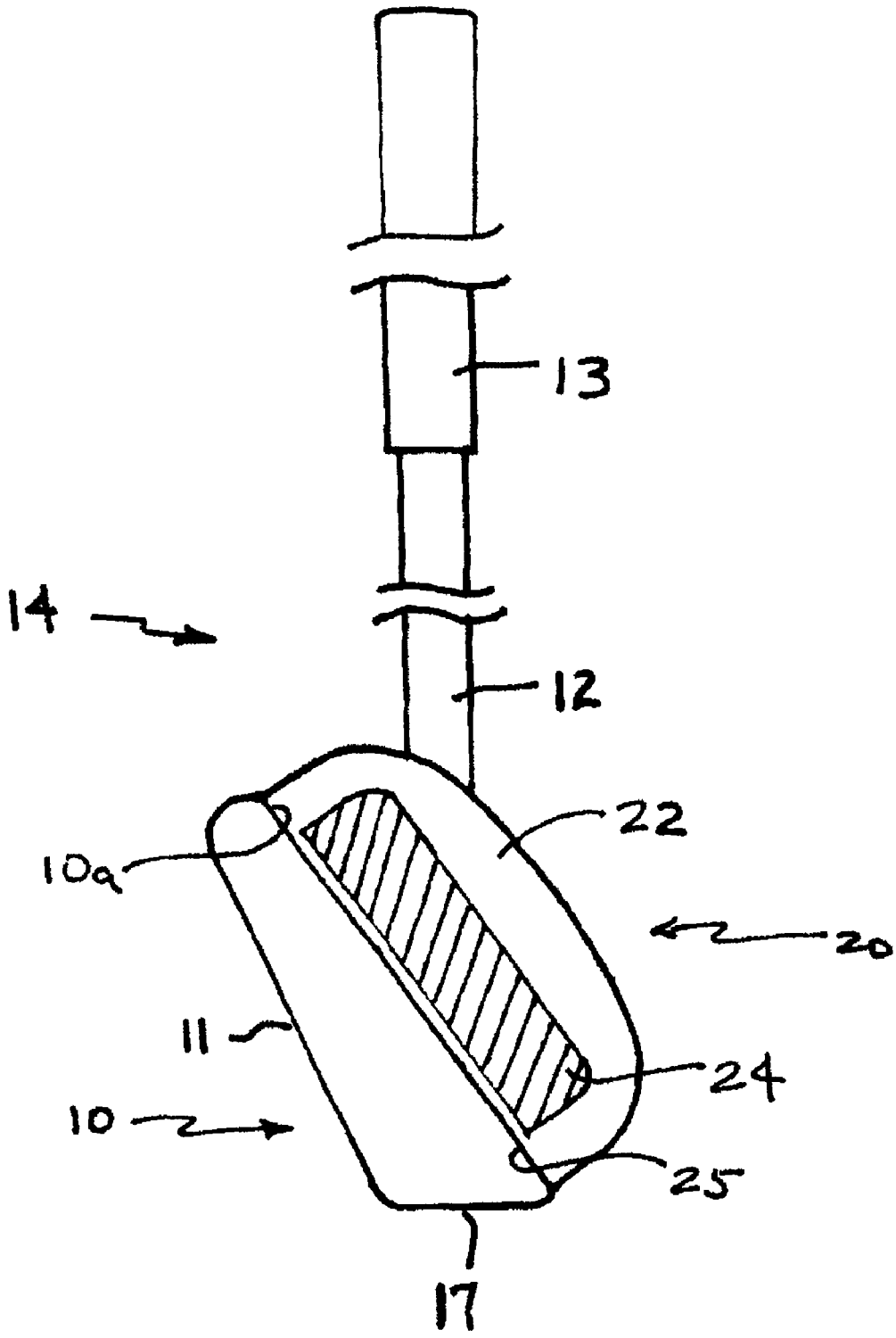
FIG. 5 is a side, cut-away view of the training apparatus of FIG. 4A taken along line 5-5 of FIG. 4A shown in relation to the prior art golf club head of FIG. 1A.

FIG. 4A is a top, cut-away view of weight 20 of FIG. 3 as taken along line 4A-4A. The back side of the casing 22 may have ends with a thickness of approximately ¾" which tapered to a thickness of ⅞" near the center thereof, resulting in a turtle back or ovoid profile effect. In the embodiment illustrated in FIG. 4A magnet 24 is disposed slightly beneath contacting surface 25, as illustrated. In this illustrative embodiment, contact surface 25 may be formed by a thin coating of either steel or another type of metal having a high enough ferrous content to transmit a magnetic field. Such coating may have a thickness of approximately 1/16" and encloses magnet 24 within casing 22. The typical manufacturing process may include the deposition of a thin layer of a material, such as steel, over the surface of magnet 24 once magnet 24 is disposed within cavity 26 of a cast or machined casing 22. FIG. 5 is a cutaway end on view of weight 20 of FIG. 4A as taken along line 5-5 in relation to the prior art golf club of FIG. 1B. In such embodiment, weight 20 has a single piece, unitary design in which the magnetic 24 resides within the interior of weight 20, as illustrated in FIGS. 4A and 5.

Figure 4B:
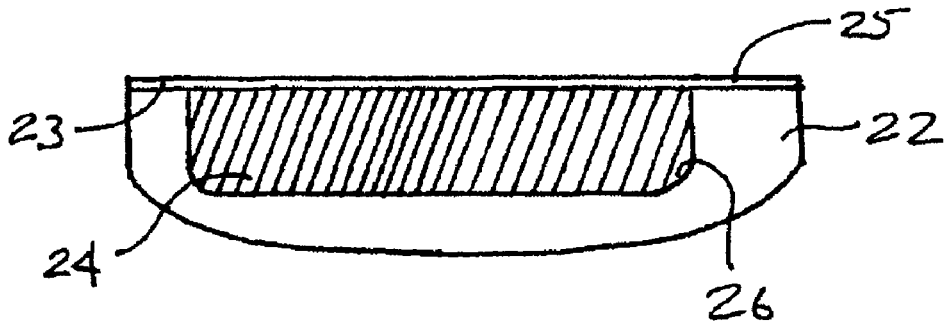
FIGS. 4B-C are similar views as FIG. 4A illustrating alternative embodiments of the training apparatus in accordance with the present invention.
Figure 4C:
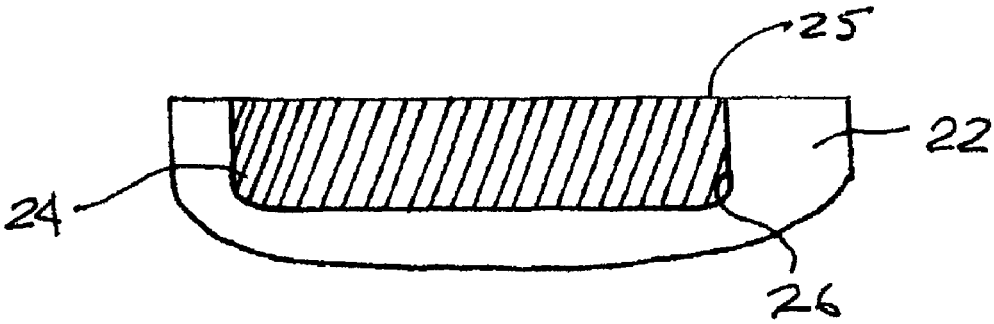

FIG. 4B illustrates an alternative embodiment of the weight 20 of FIG. 4A in which an intermediate layer 27 of any magnetically permeable material is attached to magnet 24 and casing 22 to form contacting surface 25. It is further contemplated within the present invention that all or a portion of casing 22 may be formed of any magnetically permeable material, including, but not limited to, natural or synthetic resins or fibers, in addition to metals. FIG. 4C illustrates another alternative embodiment of the weight 20 of FIG. 4A in which the exposed surface of magnet 24 serves as the contacting surface 25. In FIGS. 4A-C and 5, magnet 24, is illustrated with cross hatching.

In the various illustrative embodiment described herein, the body of casing 22 as well as the contact surface 25, and any intermediate layer 27, may comprise a metal, such as steel that is capable of becoming magnetized with the presence of a magnetic field emanating internally from within casing 22 or from an external source such as a magnet within the golf club head. It will be obvious to those reasonably skilled in the arts that other metal compositions may be used, particularly if a lighter if weight is desired for the apparatus.

Again, in the various illustrative embodiment described herein, magnets 24 and 19 may comprise any number of commercially available magnetic materials including any of the following:

Neodymium Iron Boron (general composition $Nd_2Fe_{14}B$, often abbreviated to NdFeB);

Samarium Cobalt ($Sm_1Co_5$ and $Sm_2Co_{17}$) often referred to as the SmCo 1:5 or SmCo 2:17 types;

Ceramic, also known as Ferrite, magnets (general composition $BaFe_2O_3$ or $SrFe_2O_3$), including "flexible" Ceramic magnets made by bonding Ceramic powder in a flexible binder; and Alnico magnets (general composition Al—Ni—Co).

The actual shape and material chosen for magnet 24 is left to the discretion of the designer. Rare Earth materials, such as NdFeB and SmCo, offer reasonable to high values of flux density at very high values of magnetizing force. Consequently, very short magnet lengths are needed, and the required volume of the magnetic material is small. Magnet 24 may be implemented with enough strength so that weight 20 may be manually attached and removed from club head 10 while remaining fastly secured thereto during even the most vigorous warm-up swings.

Figure 6:
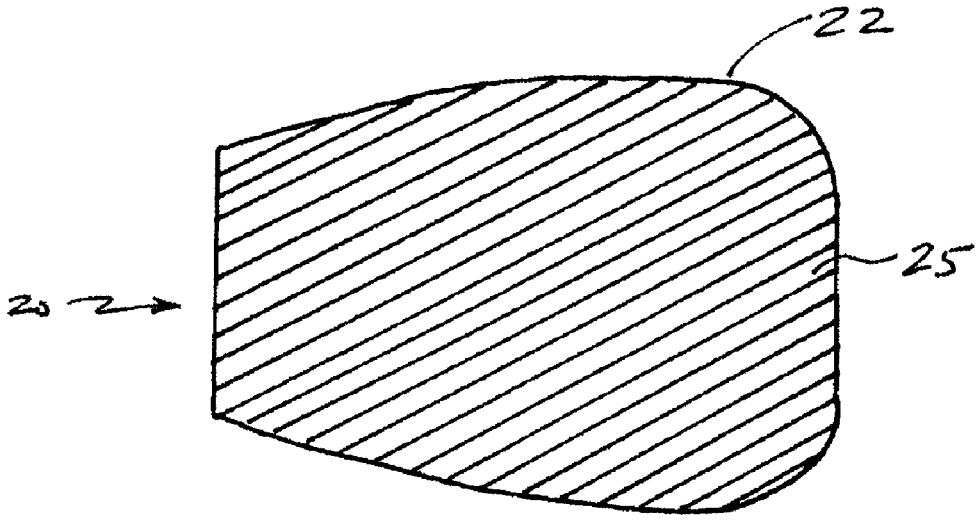
FIG. 6 is a front view of an alternative embodiment of the training apparatus in accordance with the present invention.
Figure 7A:
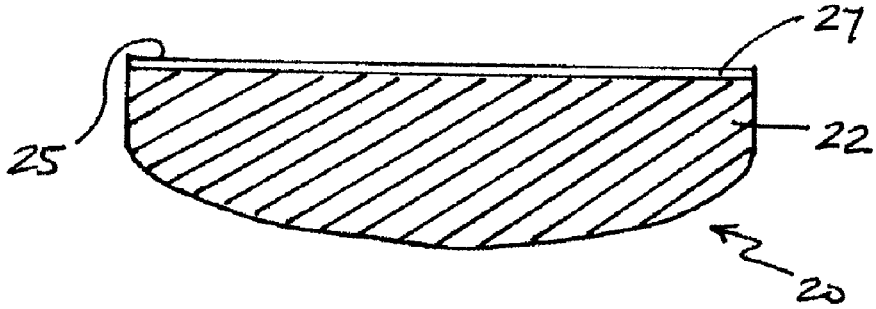
FIGS. 7A and 7B are views similar to FIGS. 4B and 4C, respectively, illustrating alternative embodiments of the training apparatus of FIG. 6 in accordance with the present invention.
Figure 7B:
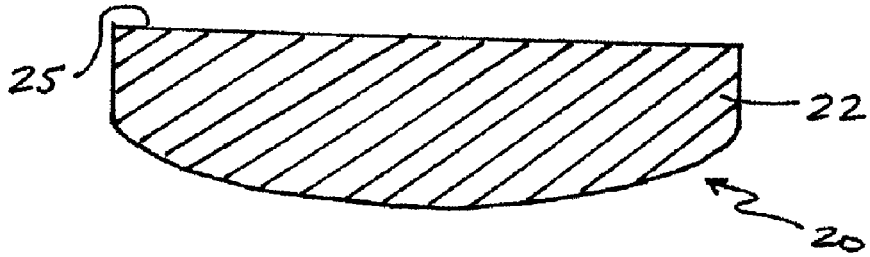

FIG. 6 is a front view of an alternative embodiment of weight 20. In this embodiment, the majority or substantially all of casing 22 and magnet 24 may comprise the same or different the magnetic materials, as illustrated with cross hatching. FIGS. 7A and 7B are views similar to FIGS. 4B and 4C, respectively, illustrating alternative embodiments of the weight 20 of FIG. 6 in accordance with the present invention. The embodiment illustrated in FIG. 7A, like that illustrated in FIG. 4B, comprises an additional intermediate layer 27 of any magnetically permeable material attached to magnet casing 22 to form contacting surface 25. The function and composition of such intermediate layer 27 may be similar to that described previously with reference to FIG. 4B. FIG. 4C illustrates the alternative embodiment of the weight 20 of FIG. 6 in which the entire casing comprises a magnetic material and an exterior surface thereof serves as the contacting surface 25.

Figure 8:
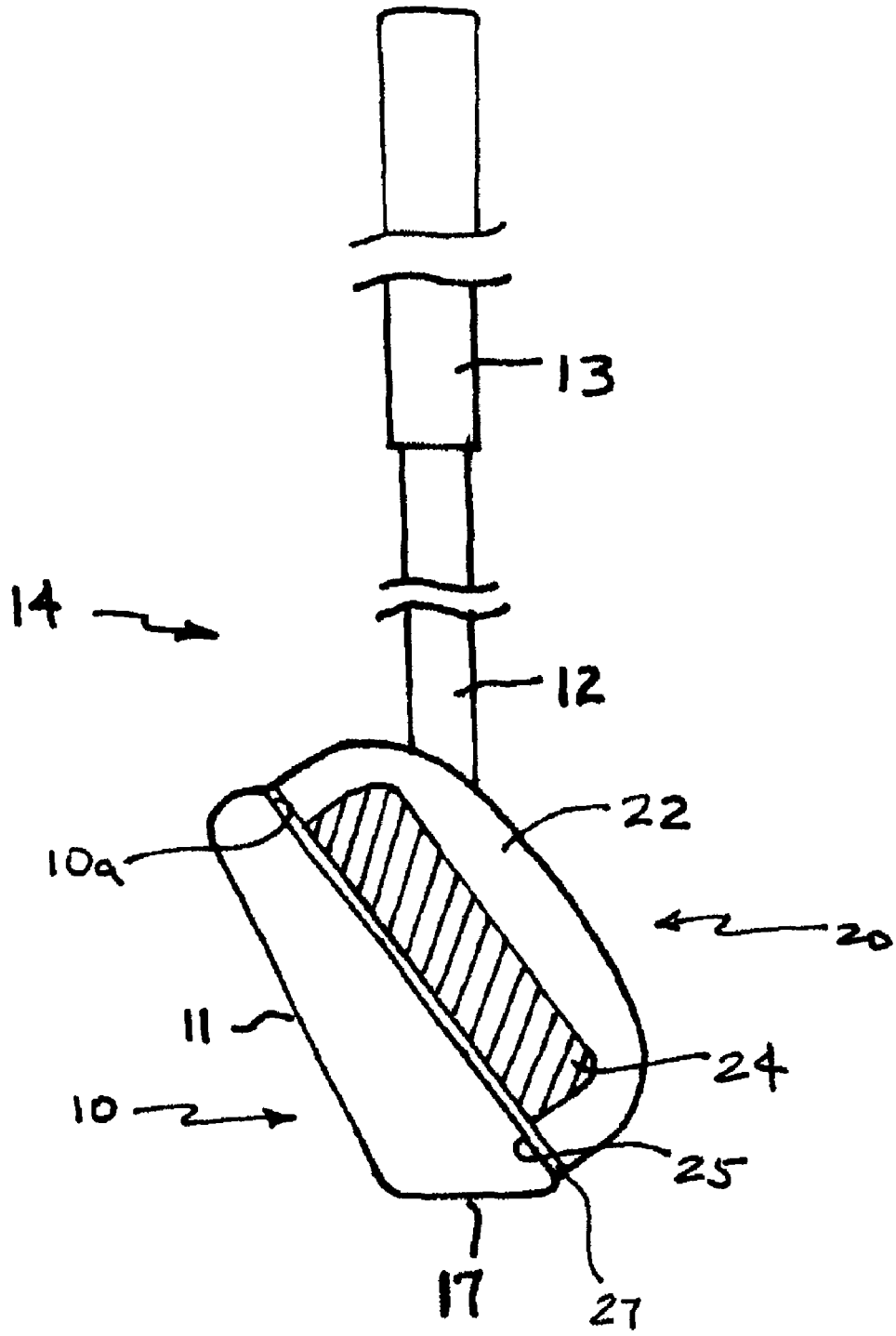
FIG. 8 is a view similar to FIG. 5 illustrating the alternative embodiment of the training apparatus of FIG. 4B shown in relation to the prior art golf club head of FIG. 1A.

In accordance with another aspect of the present invention, it is contemplated that the weight training apparatus disclosed herein may be combined with golf clubs having a prior art design similar to that illustrated in FIGS. 1A-B. Referring to FIG. 8, a golf club 14 is illustrated in combination with weight 20, similar to that illustrated in FIG. 5, and which further includes an intermediate layer 27, as previously described with reference to FIG. 4B.

Figure 9A:
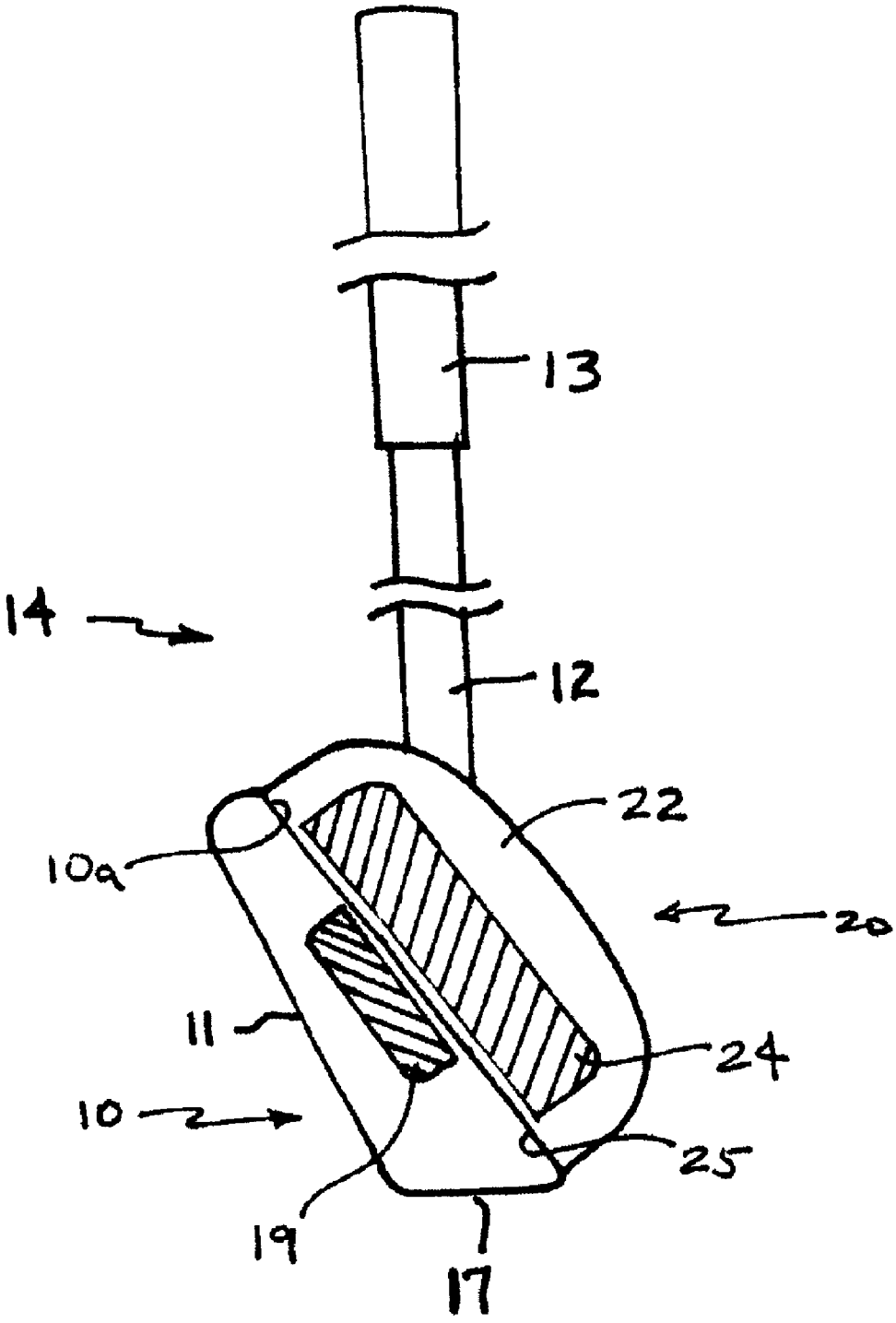
FIG. 9A is a view similar to FIG. 5 illustrating the training apparatus of FIG. 4A shown in relation to a golf club in accordance with the present invention, with the head of the inventive golf club shown in a side, cut-away view similar to the training apparatus.
Figure 9B:
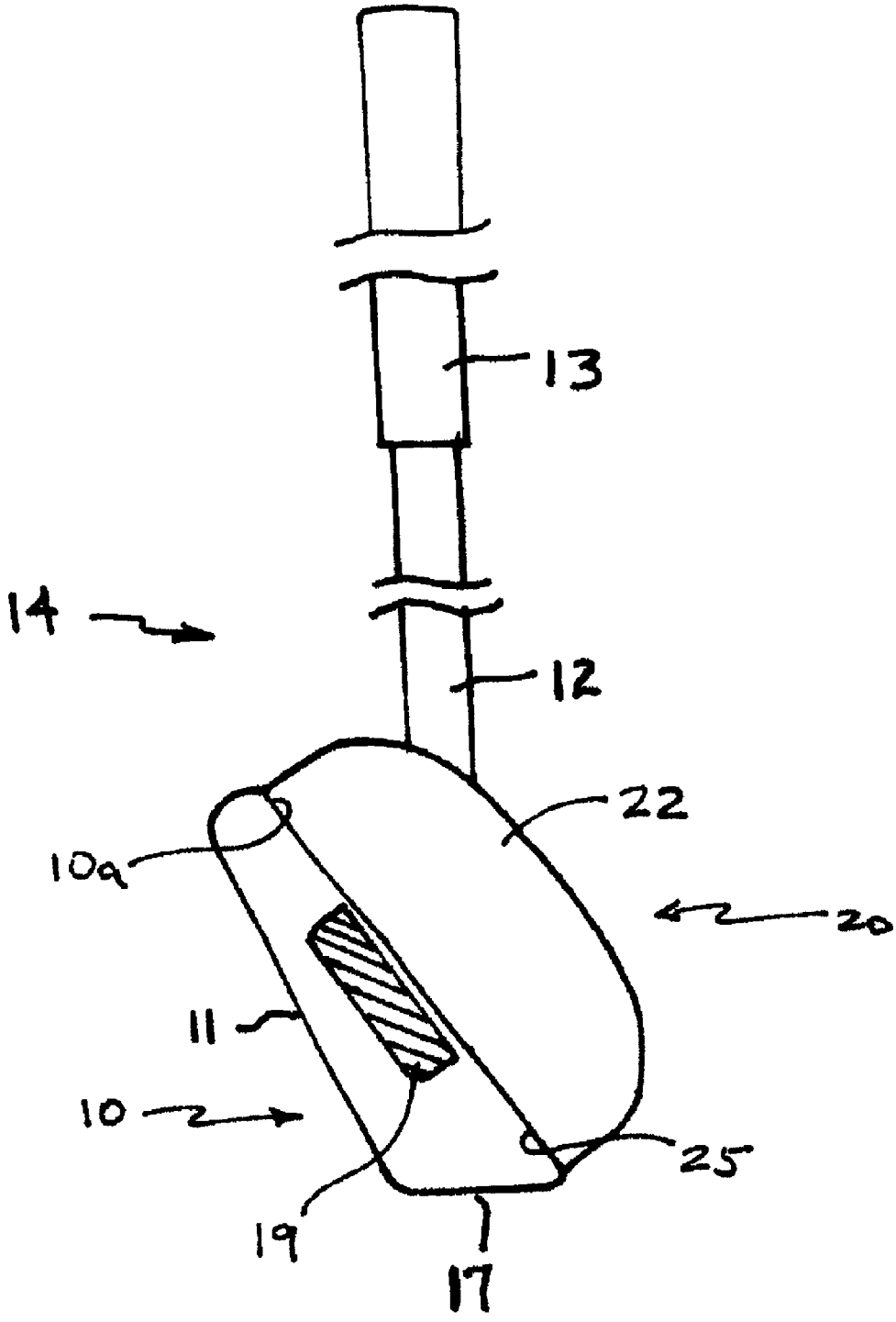
FIG. 9B is a view similar to FIG. 9A illustrating alternative embodiment of the training apparatus of FIG. 4A shown in relation to a golf club in accordance with the present invention, with the head of the inventive golf club shown in a side, cut-away view similar to the training apparatus.
Figure 10:
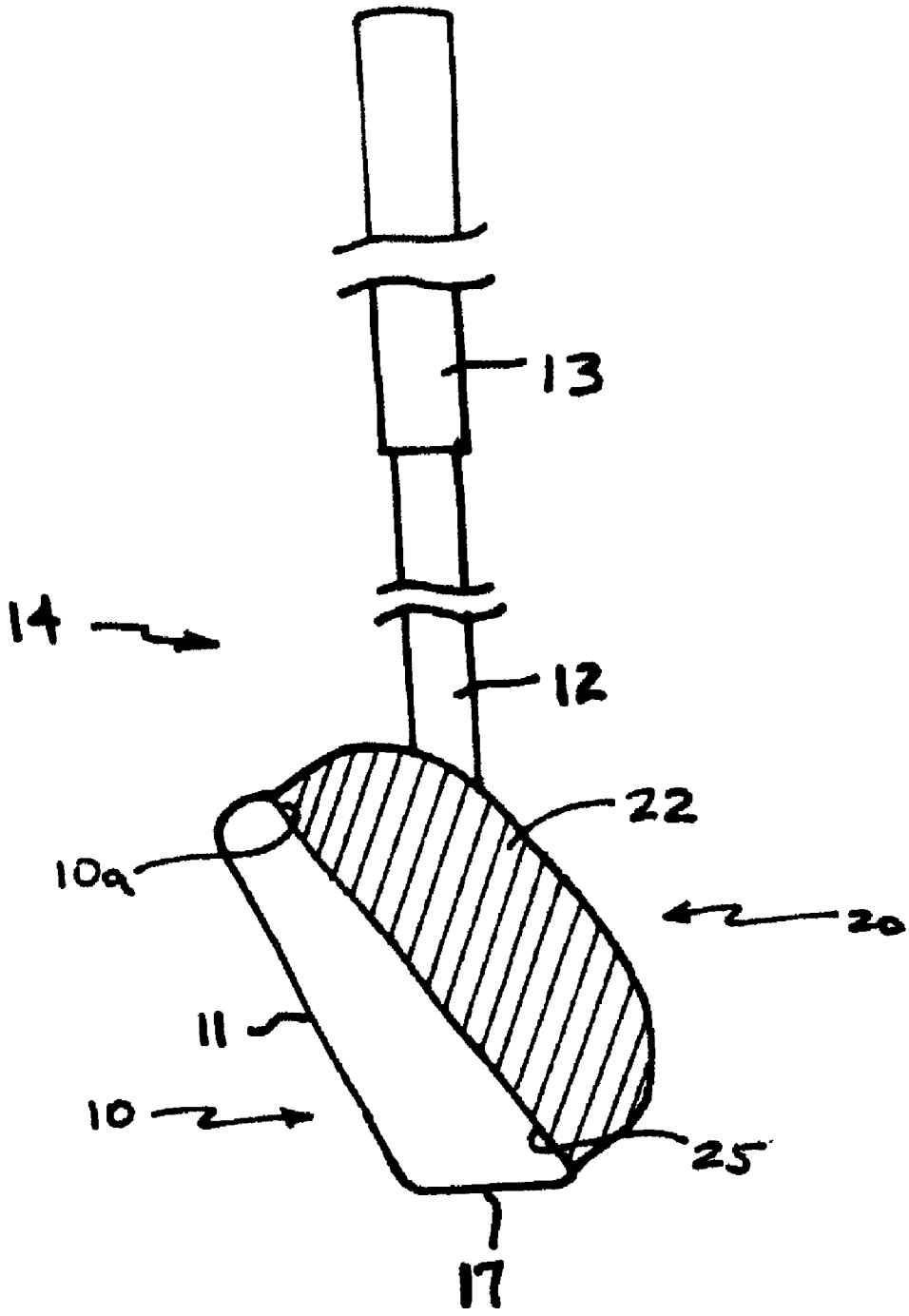
FIG. 10 is a view similar to FIG. 5 illustrating the alternative embodiment of the training apparatus of FIG. 7B shown in relation to the prior art golf club head of FIG. 1A.
Figure 11:
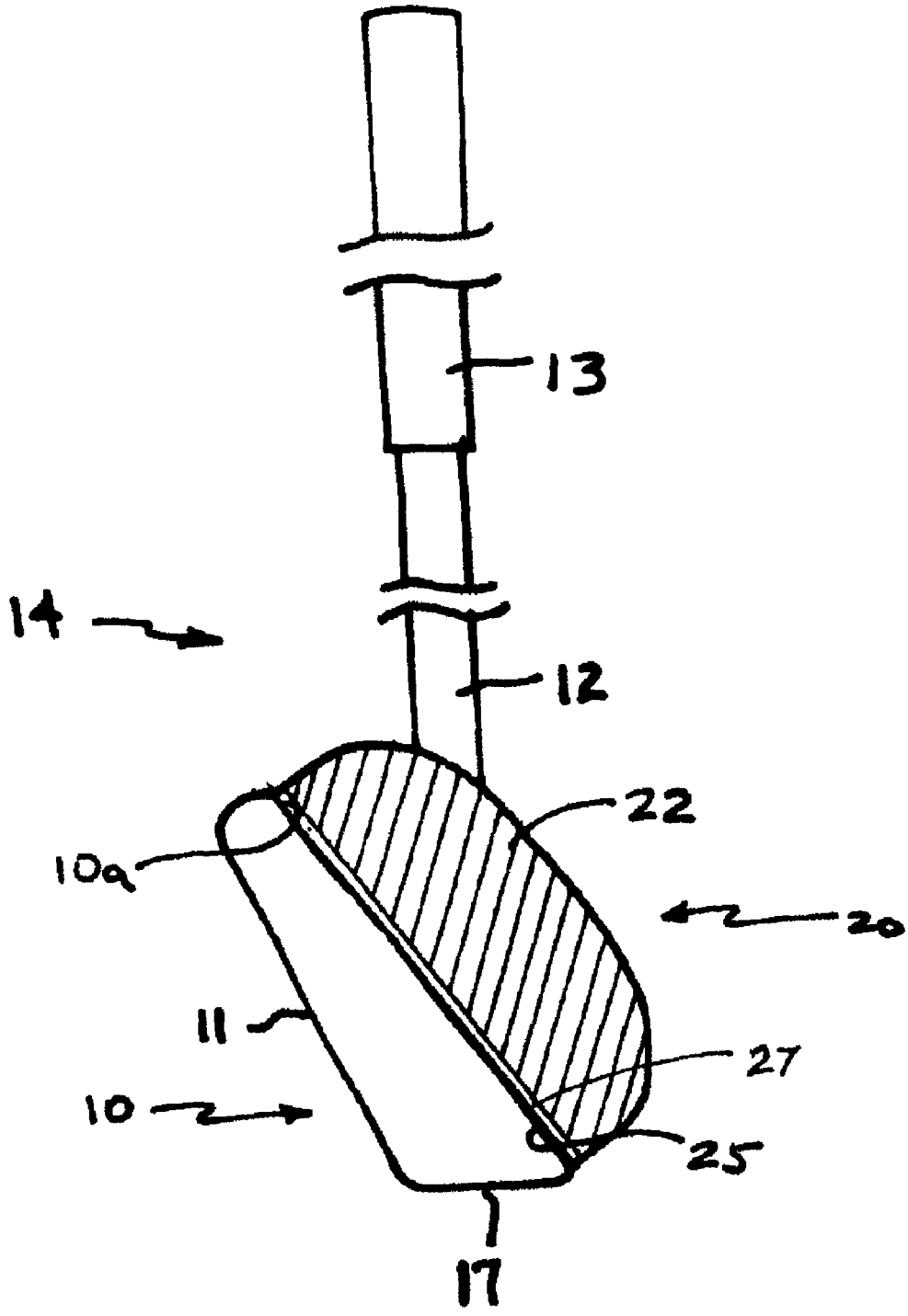
FIG. 11 is a view similar to FIG. 5 illustrating the alternative embodiment of the training apparatus of FIG. 7A shown in relation to the prior art golf club head of FIG. 1A.

FIG. 9A illustrates a weight 20, similar to that illustrated in FIG. 4A, in combination with an inventive golf club head 10 that includes a magnet 19 disposed opposite that of weight 20 to further strengthen the magnetic attraction between weight 20 and golf club head 10. In such embodiment, the dimensions and weight magnet 19 are chosen so that its presence is undetectable from a golf club having a conventional head design. The materials and processes for manufacturing the inventive golf club head 10*a* of FIG. 9A will be readily understood by those reasonably skilled in the art of golf club manufacturing in light of the weight 20 disclosured herein. FIG. 9B illustrates a golf club head 10, similar to that illustrated in FIG. 9A, in combination with an alternative embodiment of weight 20 in which casing 22 comprises a metal and is substantially devoid of an interior magnet. In this embodiment, weight 20 is attracted to club head 10 by magnet 19 of club head 10. In such embodiment, the dimensions and power of magnet 19 may be chosen to compensate for the lack of magnet in weight 20. FIGS. 10 and 11, illustrates alternative embodiments weight 20, similar to that illustrated in FIGS. 7B and 7A, respectively, in combination with a prior art golf club 14. In FIGS. 8, 9A-B, 10 and 11, the magnet material is illustrated with cross hatching.

According to another aspect of the present invention, a method of using any of the golf club/training weight combinations illustrated in FIGS. 5, 8, 9A-B, 10 and 11 comprises providing the golf club 14 and weight 20, attaching contact surface 25 of weight 20 to the striking face 10*a* of golf club head 10, and utilizing the combined club/weight combination, as necessary, to train and warm-up. If the golfer wishes to utilize the same golf club for play, the weight 20 may be manually detached and stored for subsequent use with the same or different club.

The embodiment of any of the inventive training weighs 20 described herein have been illustrated for use with a right-handed golf club so that the contacting face 25 of weight 20 rests against striking surface 10*a* of club 10. It will be obvious to those reasonably skilled in the arts that a similar inventive apparatus, which may be a similarly dimensioned, symmetrical reflection or mirror image of weight 20 may be manufactured for use with left-handed golf clubs. In addition, other contemplated alternative embodiments of weight 20 may have sizes and shapes that are adapted for use with club heads having differently dimensions striking surfaces 10*a*. Still further, other contemplated alternative embodiments of weight 20 may have dimensions and weights that accommodate golf clubs designed for use by women or juniors. Still further, other contemplated alternative embodiments of weight 20 may utilize different attachment mechanisms for securing the inventive weight to a club head, on either a temporary, semi-permanent, or permanent basis. For example, the magnets 24 and 27 disclosed in the various illustrative embodiments herein may be configured with a plurality of magnets. In addition, the magnets 24 and 27 may be permanent magnets or electromagnetics coupled to an appropriate source of electrical energy.

Having described herein illustrative embodiments of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features which have been shown and described, but shall be construed also to cover any obvious modifications and equivalents thereof.

What is claimed is:

1. A training apparatus for use with a golf club having a golf club head with a curved perimeter edge that partially defines a substantially planar striking face, the apparatus comprising:

(A) a body member of magnetizable metal comprising:

(i) a partially curved rear surface extending substantially between and conforming to the perimeter edge of the striking face of the golf club head;

(ii) a substantially planar front contacting face disposed intermediate the rear surface and the striking face and extending between and conforming to the perimeter edge of the striking face of the golf club head; and (iii) an open cavity within the body member along the contacting face;

(B) a magnet disposed within the open cavity and substantially flush with the contacting face enabling direct physical and magnetic contact between the magnet and the striking face of the golf club head; and (C) a golf club with a head wherein the club head comprises a magnetizable metal.

2. The apparatus of claim 1 wherein the magnet comprises a material selected from the group consisting of Neodymium Iron Boron, Samarium Cobalt, Ceramic and Alnico.

3. An article of manufacture for use with a golf club having a golf club head with a partially curved perimeter edge that partially defines a substantially planar striking face for impacting a golf ball, the article comprising:

(A) a golf club having a golf club head with a partially curved perimeter edge that partially defines a substantially planar striking face; and (B) a body member partially comprising a magnetizable metal and further comprising:

(i) a partially curved rear perimeter surface extending substantially between and conforming to the perimeter edge of the striking face of the golf club head;

(ii) a substantially planar front contacting face extending between and conforming to the perimeter edge of the striking face of the golf club head; and (iii) an open cavity disposed in the front contacting face;

(iv) a magnetic material disposed within the open cavity and substantially flush with the contacting face enabling direct physical and magnetic with the striking face of the golf club head; and wherein portions of the contacting face adjacent the open cavity comprise a magnetizable metal.

4. A kit comprising:

(A) a golf club having a golf club head with a partially curved perimeter edge that partially defines a substantially planar striking face;

(B) a training weight with a front planar contacting face disposable adjacent the striking face of the club and extending between and conforming to the perimeter edge of the striking face of the golf club head, the training weight having an open cavity along the contacting face; and (C) magnetic material disposed within the open cavity and substantially flush with the contacting face and physically and magnetically couplable to the striking face of the club head.

* * * * *